US005261344A

United States Patent [19]

Pickett

[11] Patent Number: 5,261,344

[45] Date of Patent: Nov. 16, 1993

[54] SELF-CONTAINED SYSTEM FOR SURFACE SHIP PROTECTION AGAINST MOORED CONTACT MINES

[75] Inventor: David M. Pickett, Clarksburg, Md.

[73] Assignee: The United States of America as represented by the Secretary of the Navy, Washington, D.C.

[21] Appl. No.: 795,436

[22] Filed: Nov. 21, 1991

[51] Int. Cl.[5] ..... B63B 21/66

[52] U.S. Cl. ..... 114/221 A; 114/245

[58] Field of Search ..... 114/244, 245, 253, 221 A, 114/276

[56] References Cited

U.S. PATENT DOCUMENTS

| | | | |
|---|---|---|---|
| 2,363,668 | 11/1944 | Groen | 114/244 |
| 2,403,036 | 7/1946 | Wilcoxon et al. | 114/244 |
| 2,524,863 | 10/1950 | White | 114/253 X |
| 3,227,123 | 1/1966 | Voigt | 114/276 |
| 3,364,891 | 1/1968 | Hook | 114/276 |
| 3,866,561 | 2/1975 | Sieber | 114/245 |
| 4,020,780 | 5/1977 | Shumaker et al. | 114/221 A |

*Primary Examiner*—Sherman D. Basinger
*Attorney, Agent, or Firm*—Howard Kaiser

[57] ABSTRACT

A minesweeping system, self-contained within the water vessel sought to be protected against contact-actuated moored mines, effective against moored mines which are directly in the path of the vessel, featuring a beam-and-float arrangement. A ruddered float is maintained by a control system in virtually forward position with respect to the vessel and is attached at the fore end of a long boom beam, the aft end of which is pivotably attached to the bow of the vessel. A depressor for maintaining submergence of the lower end of the tow wire and the inward ends of the sweepwires is attached at the lower end of the tow wire, the upper end of which is attached to the beam near the float. Port and starboard sweepwires are attached to the tow wire near the depressor, each sweepwire projecting generally horizontally and backwardly obliquely. Diverters attached at the outward ends of the two sweepwires maintain their proper orientation. Cutters are situated along the outward ends of the sweepwires. When a mine mooring cable contacts a sweepwire of the moving vessel, the mine mooring cable is deflected toward the outward end of the sweepwire and severed by a cutter, whereupon the mine rises harmlessly to the surface outside the path of the vessel.

6 Claims, 2 Drawing Sheets

SELF-CONTAINED SYSTEM FOR SURFACE SHIP PROTECTION AGAINST MOORED CONTACT MINES

The invention described herein may be manufactured and used by or for the Government of the United States of America for governmental purposes without the payment of any royalties thereon or therefor.

BACKGROUND OF THE INVENTION

The present invention relates to systems for protecting structures against deleterious contact with contact-actuated explosive devices, more particularly to systems which are for protecting surface water vessels against moored, detonation-by-contact explosive marine mines.

Explosive devices which are designed to be moored in the water and to be detonated upon contact with an enemy surface vessel have represented a longstanding and somewhat unresolved concern of naval entities. Various minesweeping systems have been utilized for neutralizing, removing or destroying these explosive marine mines.

At one time the United States Navy utilized a self-contained minesweeping system whereby a device which was attached to the bow of the surface ship would divert mines to the side; however, this system proved unsatisfactory and is no longer used by the U.S. Navy, as it failed to effectively protect against mines which were directly in the path of the ship.

Other self-contained minesweeping schemes utilized by the U.S. Navy in the past employed a remotely powered vehicle in front of the ship; however, these schemes were not entirely efficient in terms of cost, complexity, maintenance, reliability and fueling requirements.

Eventually the U.S. Navy discontinued the notion of autonomous, self-contained minesweeping systematization in favor of dependent minesweeping systematization whereby a minesweeping vessel leads other ships through mined or potentially mined waters. Although this latter system has proven effective in terms of protection it necessitates implementation of a specially designed minesweeping vehicle; hence, this dependency system is inherently self-limiting inasmuch as non-minesweeping vessels cannot hazard these dangerous waters on their own. It is therefore desirable to attain an effective and efficient minesweeping system which is a self-contained constituent of the vessel sought to be protected.

OBJECTS OF THE INVENTION

In view of the foregoing, it is an object of the present invention to provide a more effective self-contained minesweeping system for a single marine vessel.

It is a further object of the present invention to provide a more efficient self-contained minesweeping system for a single marine vessel.

SUMMARY OF THE INVENTION

The present invention provides a self-contained minesweeping system for protecting a surface vessel from deleterious contact with explosive mines in water, the vessel moving through the water in a path generally forward of the bow of the vessel, each mine having mooring means attached to the mine. The present invention comprises a mount, a boom, a float, lateral deviation control means, a tow wire, a port sweepwire, a starboard sweepwire, port diverting means, starboard diverting means, port cutting means, starboard cutting means, and depressing means.

The mount is located at the bow of the vessel. The boom has a fore end and an aft end, the aft end pivotably attached to the vessel at the mount and the fore end projecting from the vessel in a generally forward and downwardly oblique direction. The float is buoyant in the water and attached to the boom at the fore end of the boom. The tow wire has an upper end and a lower end, the upper end attached to the boom at a location adjacent the fore end of the boom.

The lateral deviation control means maintains the projecting of the fore end of the boom in the generally forward direction, whereby the line defined by the length of the boom lies in a vertical plane which is maintained at an angle approaching zero degrees with respect to the line defined by the length of the vessel.

The port sweepwire has an inward end and an outward end. The inward end of the port sweepwire is attached to the tow wire at a location adjacent the lower end of the tow wire, the outward end of the port sweepwire projecting in a generally horizontal and backwardly oblique portwise direction, whereby the port sweepwire deflects toward the outward end of the port sweepwire each mine having a mooring means which contacts the port sweepwire. The starboard sweepwire has an inward end and an outward end. The inward end of the starboard sweepwire is attached to the tow wire at a location adjacent the lower end of the tow wire, the outward end of the starboard sweepwire projecting in a generally horizontal and backwardly oblique starboardwise direction, whereby the starboard sweepwire deflects toward the outward end of the starboard sweepwire each mine having a mooring means which contacts the starboard sweepwire.

Port diverting means is attached to the port sweepwire at the outward end of the port sweepwire. The port diverting means hydrodynamically maintains the outward end of the port sweepwire projecting in the generally horizontal and backwardly oblique portwise direction. Starboard diverting means is attached to the starboard sweepwire at the outward end of the starboard sweepwire. The starboard diverting means hydrodynamically maintains the outward end of the starboard sweepwire projecting in the generally horizontal and backwardly oblique starboardwise direction.

The port cutting means is attached to the port sweepwire at a location adjacent the outward end of the port sweepwire, whereby the mooring means attached to each mine which is deflected toward the outward end of the port sweepwire is severed by the port cutting means and the mine rises to the surface of the water outside the path of the vessel. The starboard cutting means is attached to the starboard sweepwire at a location adjacent the outward end of the starboard sweepwire, whereby the mooring means attached to each mine which is deflected toward the outward end of the starboard sweepwire is severed by the starboard cutting means and the mine rises to the surface of the water outside the path of the vessel.

Depressing means submerged in the water is attached to the tow wire at the lower end of the tow wire. The depressing means maintains submergence in the water of the lower end of the tow wire, the inward end of the port sweepwire, and the inward end of the starboard sweepwire.

In preferred embodiments the lateral deviation control means includes sensing means contained in the mount, rudder control means contained in the float, and transmitting means for sending electrical signals from the sensing means to the rudder control means, whereby the transmitting means continuously sends the electrical signals to the rudder control means from the sensing means and the rudder control means continuously steers the float in accordance with the signals so as to maintain the angle approaching zero degrees.

The present invention features a beam-and-float arrangement whereby the boom beam is directionally controlled so as to be maintained at zero angle (or nearly zero angle) in terms of lateral deviation with respect to the vertical plane which passes through the line defined by the length of the ship. The float is attached to the boom beam at the fore end of the beam and communicates with the ship so as to be thus directionally maintained in a forward or virtually forward position with respect to the ship. Since the beam, in pushing the float, is subjected to force from the ship which is directed longitudinally along the beam, the beam is predominantly loaded in compression and relatively insignificantly loaded in bending; bending load, if any, would be primarily attributable to the downward angle of the beam from the mount.

A manifest advantage of this invention's beam-and-float arrangement is that, because of the sizably diminished bending load on the boom beam, it admits of use of a boom beam which is significantly longer than that which could be used having less propitious boom beam loading characteristics. In accordance with this invention, the sweepwires are attached to the tow wire which in turn is attached at or near the front end of a boom beam, a very long boom beam is preferred embodiments; hence, the sweepwires are well out in front of the moving ship and thus a sufficient distance in front so as to allow time to divert mines away from the ship's path before contact between the ship and the mine can occur. Thus the present invention's system is advantageous over the self-contained system previously utilized by the Navy wherein a minesweeping device was attached directly to the ship's hull. A self-contained system which would ineffectually attempt to implement a significantly bending-loaded and hence necessarily short beam to which a minesweeping device is attached would provide no appreciable advantage over the Navy's direct attachment approach. As a self-contained minesweeping system, the present invention is singularly effective against mines which are directly in the path in which the approaching ship will move.

Moreover, the present invention provides a system which is economically feasible and eminently practical. Wires and its other various parts are readily available or are easily made or adapted. The electronics involved is well known in the art. No fuel is required for the float, and the ability to refuel the float is therefore not a concern. Cost, complexity and maintenance are minimized, reliability increased.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
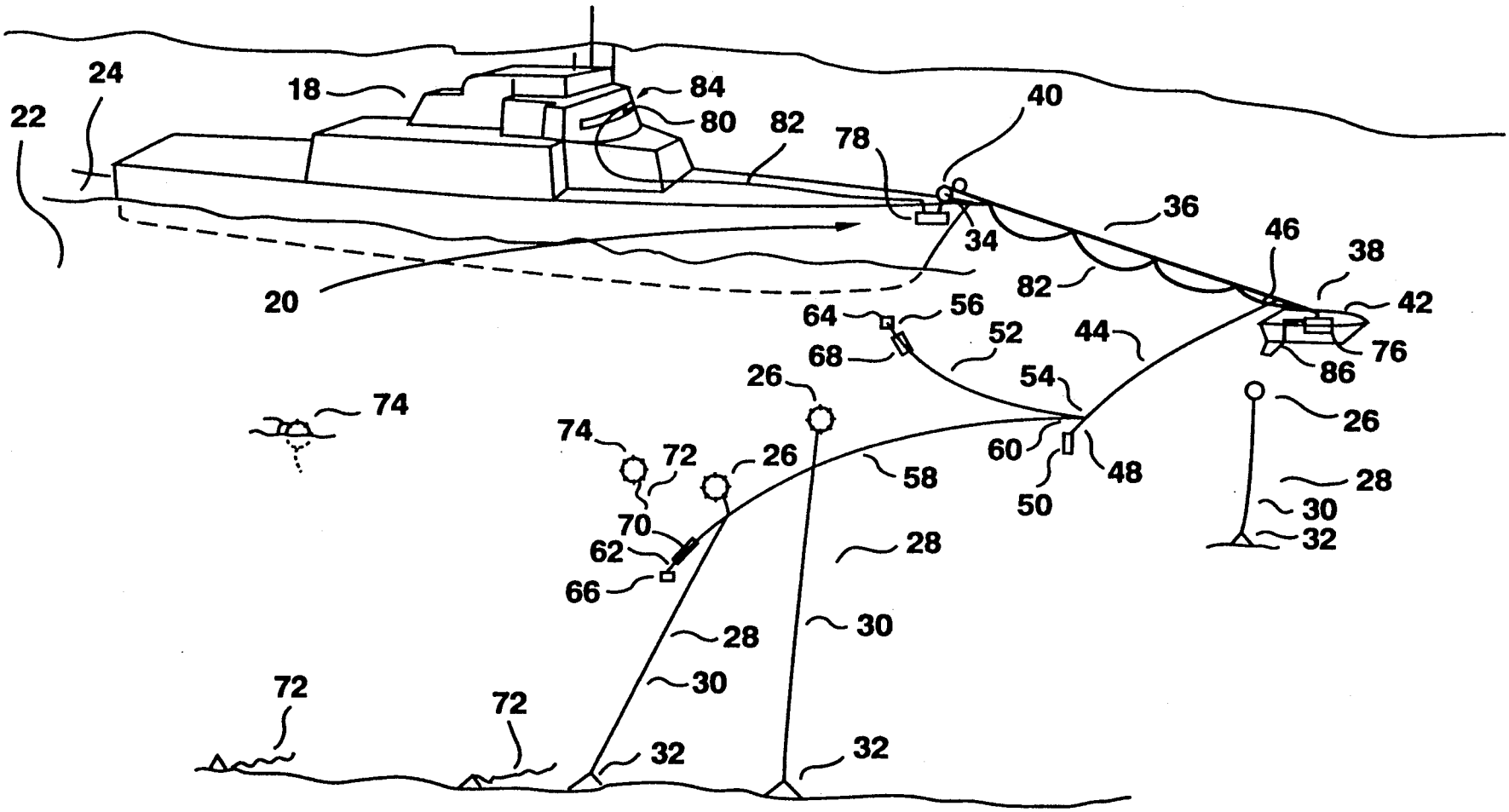
FIG. 1 is a diagrammatic perspective view of a surface ship utilizing the minesweeping system of the present invention.

Referring now to FIG. 1, surface ship 18 is navigating water 22 having water surface 24. Water 22 contains at least one moored mine 26 having mine mooring 28, each mine mooring 28 including mine mooring cable 30 and mine mooring anchor 32.

Boom mount 34 is located at bow 20 of ship 18. Boom 36 is a long beam having aft end 40 which is pivotably attached to ship 18 at mount 34. Boom 36 admits of great length because it is not heavily loaded in bending and is predominantly loaded in compression. Fore end 38 of boom 36 projects from ship 18 in a generally forward and downwardly oblique direction. Buoyant in water 22 is float 42, attached to boom 36 at fore end 38 of boom 36.

Boom 36 is rigid; however, it must have sufficient flexibility for withstanding bending, to the extent that there is bending, without breakage. Boom 36 is made of any material satisfying the compression and strength requirements for practice of this invention, such as but not limited to wood, metallic (e.g., steel or aluminum), plastic, fiberglass or composite.

Boom 36 is pivotably attached to ship 18 so as to allow free rotation of boom 36 to all degrees and in all directions which are within the scope of its rotational directional limits. Boom 36 is of sufficient rotational directional scope for permitting unimpeded buoyancy of float 42. In many embodiments aft end 40 and mount 34 are engaged in ball-and-socket fashion for accomplishing this sufficiency of free rotation of boom 36. The requisite scope of freely rotational direction depends on the specific embodiment; relevant parameters include length of boom 36 and range of height of mount 34 above water surface 24 in view of minimum and maximum drafts of ship 18. Techniques for effectuating this boom mounting with requisite boom movement are well known in the art.

Upper end 46 of tow wire 44 is attached to boom 36 at a location on boom 36 which is aft of and in close proximity to the location at which float 42 is attached to boom 36. Depressor 50, submerged in water 22, is attached to tow wire 44 at lower end 48 of tow wire 44. Depressor 50 provides downward force so as to maintain submergence in water 22, below the maximum draft of ship 18, of lower end 48 of tow wire 44, inward end 54 of port sweepwire 52, and inward end 60 of starboard sweepwire 58.

For some embodiments more than one depressor 50 is used. Generally, for many embodiments of this invention, a plurality of depressors 50 may be used instead of a single (usually, larger) depressor 50 so as to exert the desired downward force.

Various types of depressors are well known in the art, notably among them the Mark (MK) 2 Mod 0 depressor disclosed in U.S. Naval Publication NAVAIR 11-80MS-6, Rev 1, *Mark* 103 *Mod* 2 *Mechanical Minesweeping Gear: Technical Manual, Operation and Maintenance*

*Instructions, With Illustrated Parts Breakdown*, Aug. 1, 1977, incorporated herein by reference as if fully set forth herein. The MK2 Mod 0 is illustrated therein in FIG. 2-4 and described therein at page 2-2 as "an airplane-type lifting body used in conjunction with the lead float to maintain the inboard portion of the gear at a preselected depth. The depressor consists of an aluminum wing and tail assembly, and a streamlined lead ballast." It may also be seen from the above-cited NAVAIR 11-80MS-6 and from other publications that various types of float 42, tow wire 44, sweepwires 52 and 54, and diverters 64 and 66 such as would be appropriately implemented in accordance with various embodiments of the present invention are well known in the art.

Inward end 54 of port sweepwire 52 is attached to tow wire 44 at a location on tow wire 44 which is above and in close proximity to the location at which depressor 50 is attached to tow wire 44; similarly, inward end 60 of starboard sweepwire 58 is attached to tow wire 44 at a location on tow wire 44 which is above and in close proximity to the location at which depressor 50 is attached to tow wire 44.

Tow wire 44 and sweepwires 52 and 58 in accordance with this invention are high strength and varyingly rigid or flexible; however, as it is conventional in the art to use flexible minesweep wires, sweepwires 52 and 58 are flexible cable for most embodiments of this invention. Tow wire 44 for most embodiments is also a high strength flexible cable; because the ability to withstand surface abrasion is not a significant factor, tow wire 44 is made of any high strength flexible material such as steel or a synthetic material. Sweepwires 52 and 58, on the other hand, must each be sufficiently durable to withstand the abrasive, outwardly longitudinal motion therealong of mine mooring cable 30 before mine mooring cable 30 reaches cutter 68 or 70; hence, sweepwires 52 and 58 are preferably made of steel flexible cable. Various types of strong, flexible cable are known in the art to be used in the context of conventional minesweeping systems. Primarily because of the dynamics of movement through water 22 of ship 18, depressor 50 and diverters 64 and 66, flexible sweepwires 52 and 58 are backwardly convex.

Port diverter 64 is attached to port sweepwire 52 at outward end 56 of port sweepwire 52; similarly, starboard diverter 66 is attached to starboard sweepwire 58 at outward end 62 of starboard sweepwire 58. Diverters 64 and 66 have also been variously called "paravanes" and "otters." Port diverter 64 and starboard diverter 66 serve to hydrodynamically maintain, respectively, outward end 56 in a generally horizontal and backwardly oblique portwise direction, and outward end 62 in a generally horizontal and backwardly oblique starboardwise direction.

Diverters 64 and 66 must be maintained submerged in water 22 at a great enough depth for the cutters 70 and 72 to function properly by cutting mine mooring cables 30 without coming perilously close to moored mine 26. For preferred embodiments port diverter 64 and starboard diverter 66 are preset to operate at an ordered depth which is deeper than the maximum draft of ship 18.

Well known in the art are various types of diverters which employ various methodologies and systems for maintaining the diverters at a predetermined depth. David M. Pickett et al. at U.S. Pat. No. 4,463,701, incorporated herein by reference, disclose a "Paravane with Automatic Depth Control," an electromechanical diverter which includes an elongated fuselage, a wing section, stabilizer fins, a depth control flap, and depth control means which controls the position of the depth control flap and which is operable in response to hydrostatic pressure. Pickett et al. also disclose prior art approaches to diverter depth control. For example, one approach utilizes an adjustable cable length which connects the submerged diverter component to a floating device. Another approach utilizes a depth sensor which is coupled with a rudder or control flap. The diverter of Pickett et al. is advantageous in that it provides a high lift coefficient, a low drag coefficient, increased stability and decreased oscillation.

Among other diverters known in the art are those described in U.S. Naval Publication *Index of Mine Countermeasures Material*, October 1954, NAVSHIPS 250-620-30 at pages 2-36, 2-40 and 2-41 therein, incorporated herein by reference. The "Paravane S (Type C) Port or Starboard" is a mechanical spring-type diverter described as "(a) device used for high speed minesweeping to divert the out-board end of the sweep wire away from the sweeper and to hold the sweep wire at a predetermined depth. A combination hydrostatic valve and mercury oscillator mechanism controls the depth and maintains the paravane in a horizontal position when running at its set depth. A pivoting biplane assembly automatically changes the position of the biplane to allow operation in either of two positions. The biplane assembly remains in the low speed position until the compression on the side springs is overcome by the pressure on the planes which automatically produces a change-over to the high speed position. When the biplane assembly is in the high speed position the lift on the planes is decreased thus allowing the sweeper to operate at a higher speed without subjecting the sweep wire to excessive loads. The S (Type C) Mod 1 paravane is a modification of the S (Type C) paravane accomplished to facilitate manufacture and assembly without affecting the performance." The Otter Size 5G (NM) is a nonmagnetic diverter described as "a single vane device used for diverting the sweep wire in the MSB class vessels only." The Kite-Otter is a multiplane diverter which doubles as a depressor. "When used as an otter it is rigged with a four chain bridle, and when used as a depressor it is rigged with a three leg chain bridle."

Port minesweeping cutters 68 are attached to port sweepwire 52 at a location on port sweepwire 52 which is inward of and in close proximity to the location at which port paravane 64 is attached to port sweepwire 52; similarly, starboard minesweeping cutters 70 are attached to starboard sweepwire 58 at a location on starboard sweepwire 58 which is inward of and in close proximity to the location at which starboard paravane 66 is attached to starboard sweepwire 58. Each one of cutters 68 and 70 must be sufficiently distanced from the side of the hull of ship 18 that, upon conversion of mine mooring cable 30 to severed mine mooring cable 72 by cutter 68 or cutter 70, unmoored mine 74 rises to water surface 24 outside the path of ship 18, and ship 18 navigates safely past unmoored mine 74 through the entire time that unmoored mine 74 ascends in subsurface water 22 and achieves and establishes buoyancy on water surface 24. Moreover, it is often desirable for the vessel which implements the present invention to be able to successfully defend against multiple encounters with explosive mines. For such embodiments a plurality of port cutters 68 and starboard cutters 70 is preferred; many such embodiments can reasonably expect to fend off multiple mine threats by equipping this invention with about five port cutters 68 and five starboard cutters 70. The cutters 68 and 70 should not only be sufficiently distanced from ship 18 and its path but should also be sufficiently distanced from each other so as to permit proper functioning of each individual cutter unit. Hence, cutters 68 and 70 in accordance with this invention should be sufficiently numerous and appropriately situated, spaced apart and distributed along sweepwires 52 and 58 for practicing this invention.

Minesweeping cutters 68 and 70 are of any type which are known in the art. One type of cutter mechanism will, upon actuation, fire an impulse cartridge which drives a member which in turn cuts the mooring. For example, the Mark 17 Mod 0 Powder Actuated Minesweeping Cutter, which has been utilized as the cutting element in minesweeping systems by the U.S. Navy, has a body assembly, an elevating fin, and front and rear liners. The *Technical Manual* of *Description, Operation, and Maintenance Instructions With Illustrated Parts Breakdown* for *Cutter, Powder Actuated Minesweeping Mark* 17 *Mod* 0, NAVAIR 11-80MS-5(IR), Rev 1, Published by Direction of Commander, Naval Air Systems Command, Oct. 1, 1976, is hereby incorporated by reference as if fully set forth herein.

Among other cutters known in the art are those desribed in the aforecited U.S. Naval Publication *Index of Mine Countermeasures Material*, NAVSHIPS 250-620-30, at pages 2-23, 2-24, 2-25, and 2-26 therein, incorporated herein by reference. The Mark 9, Mark 11 and "V" models are standard mechanical cutters equipped with a steel frame and steel cutter blades. The Mark 9 and Mark 11 are available in both magnetic and non-magnetic versions. The Mark 9 is provided with a detachable fin; the Mark 11 has a fin bolted onto the frame. It is noted that many types of cutters 68 and 70 known in the art employ or are recommended to employ a fin-like member or members which serve to orient the cutter in terms of functional effectiveness. The Mark 12 Mod 1 and Mark 13 MOD 1 explosive minecutters each have a metallic cutter frame, an elevating fin, and explosive components. The Mark 9, Mark 11 and Mark 12 MOD 1 are available in both magnetic and non-magnetic versions. It is further noted that some cutters of the explosive variety are designed so as to be actuated once and then rendered nonfunctional.

Nonmagnetization of various components such as cutters 68 and 70, diverters 64 and 66, and depressor 50 is preferred for those embodiments wherein ship 18 may be expected to hazard water 22 containing magnetic-field-actuated moored mines 26 in addition to contact-actuated moored mines 26; in such situations as low a magnetic signature as possible is sought to be achieved for ship 18 so as to minimize the risk of setting off a magnetic-type mine 26.

Figure 2:
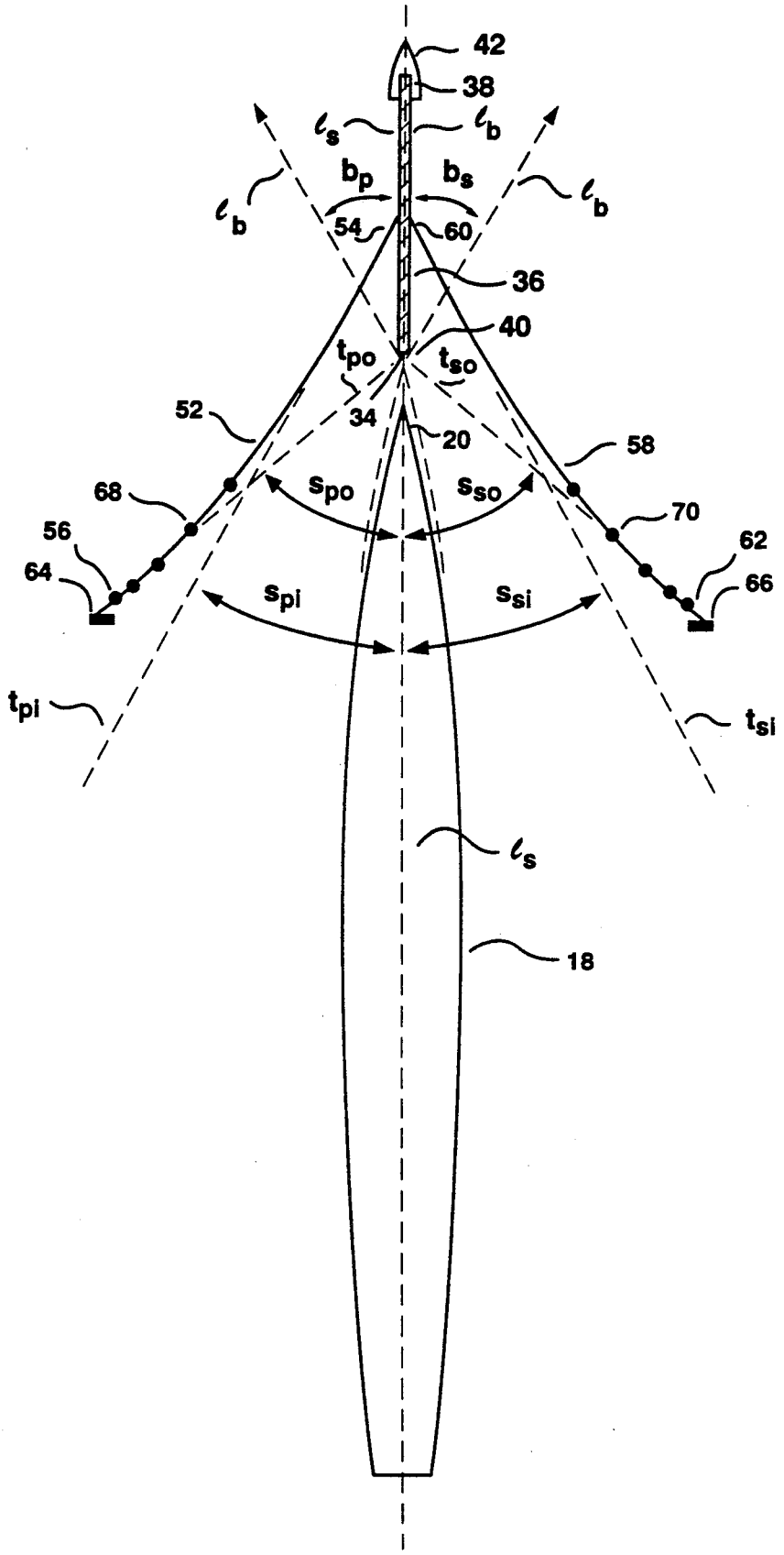
FIG. 2 is a diagrammatic top plan view of the ship and minesweeping system shown in FIG. 1, illustrating the bow of the ship and the boom, float, sweepwires, diverters and cutters of the minesweeping system.

With reference to FIG. 2, lengthwise ship line $\mathbf{1}_s$ is the line defined by the length of ship 18. Lengthwise boom line $\mathbf{1}_b$ is the line defined by the length of boom 36, shown having boom line $\mathbf{1}_b$ in the zero angle position with respect to line $\mathbf{1}_s$. Boom 36 deviates laterally in either the portwise direction or the starboardwise direction, whereby boom line $\mathbf{1}_b$ deviates laterally a portwise boom deviation angle $b_p$ and a starboardwise boom deviation angle $b_s$. Boom line $\mathbf{1}_b$ is continuously maintained, by lateral deviation control means, with lateral deviation angles $b_p$ and $b_s$ tending toward and approximating zero degrees—i.e., with boom 36 positioned such that the vertical plane through $\mathbf{1}_b$ approaches coincidence with $\mathbf{1}_s$, or, alternatively stated, such that $\mathbf{1}_b$ approaches coincidence with the vertical plane through $\mathbf{1}_s$.

Sweepwires 52 and 58 are at an acute angle with respect to the vertical plane through line $\mathbf{1}_s$. As shown in FIG. 2, inward port sweepwire tangent $t_{pi}$ is the line tangent to inward end 54 of port sweepwire 52 so as to represent inward port sweepwire angle $s_{pi}$, which reflects the angle which port sweepwire 52 would assume with respect to the vertical plane through $\mathbf{1}_s$ if port sweepwire 52 projected outwardly from tow wire 44 linearly rather than curvilinearly. Inward starboard sweepwire tangent $t_{si}$ is the line tangent to inward end 60 of starboard sweepwire 58 so as to represent inward starboard sweepwire angle $s_{si}$, which reflects the angle which starboard sweepwire 58 would assume with respect to the vertical plane through $\mathbf{1}_s$ if starboard sweepwire 58 projected outwardly from tow wire 44 linearly rather than curvilinearly.

Since sweepwires 52 and 58 are backwardly arched, outward ends 56 and 62 are disposed at a less acute angle in relation to line $\mathbf{1}_s$. Outward port sweepwire tangent $t_{po}$ is the line tangent to outward end 56 of port sweepwire 52 so as to represent outward port sweepwire angle $s_{po}$, which reflects the angle which port sweepwire 52 would assume with respect to the vertical plane through $\mathbf{1}_s$ if port sweepwire 52 projected inwardly from port diverter 64 linearly rather than curvilinearly. Outward starboard sweepwire tangent $t_{so}$ is the line tangent to outward end 62 of starboard sweepwire 58 so as to represent outward starboard sweepwire angle $s_{so}$, which reflects the angle which starboard sweepwire 58 would assume with respect to the vertical plane through $\mathbf{1}_s$ if starboard sweepwire 58 projected inwardly from starboard diverter 66 linearly rather than curvilinearly.

Inward sweepwire angles $s_{pi}$ and $s_{si}$, for many embodiments, are each about 30°; for most embodiments sweepwire angles $s_{pi}$ and $s_{si}$ are each less than 45°. Outward sweepwire angles $s_{po}$ and $s_{so}$ are each greater than 45° for most embodiments, for many embodiments on the order of 60° or 70°.

Port-starboard symmetry of the minesweeping system about ship line $\mathbf{1}_s$ is a preferred feature of the present invention because the forces exerted on the port and starboard sides of $\mathbf{1}_s$ should be equal and opposite so as to neutralize each other or balance each other out. Hence, in preferred embodiments: Inward end 54 and inward end 60 are attached to tow wire 44 at the same or very nearly the same location; port sweepwire 52 and starboard sweepwire 58 are the same or very nearly the same length; port diverter 64 and starboard diverter 66 are functionally equivalent or very nearly equivalent; port cutters 68 and starboard cutters 70 are at least somewhat correspondingly located along the respective sweepwires 52 and 58.

Referring again to FIG. 1, lateral deviation control means includes rudder control unit 76, angle sensing unit 78, master control/manual override unit 80 and power/control cables 82. Float 42 is a small boat which is modified to contain rudder control unit 76 and rudder 86. Rudder control unit 76, relying on feedback from angle sensing unit 78, controls rudder 86 so as to hydrodynamically act to maintain float 42 directly in front of ship 18. Angle sensing unit 78, located at or near boom mount 34, measures lateral deviation angles $b_p$ and $b_s$ and continually commands rudder control unit 76 to maintain lateral deviation angles $b_p$ and $b_s$ approaching zero degrees.

Master control/manual override unit 80, shown located in bridge 84, is preferably also included, in many embodiments, as a back-up constituent of the lateral deviation control means. Master control/manual override unit 80 contains system monitor functions; in the event that the system coupling rudder control unit 76 with angle sensing unit 78 should fail, master control/-manual override unit 80 allows manual override of the system and direct manual control of rudder control unit 76.

The electrical functions are preferably tied together by power/control cables 82 having electrical conducting wire, at least some of the cables 82 coupled with and following along boom 36. Boom 36 thus provides a practical vehicle for engaging transmitting means of electrical signals from angle sensing unit 78 to rudder control unit 76. Cables 82 for some embodiments also provide transmitting means of electrical signals for effectuating unit 80 master control/manual override functions. Alternatively, in some embodiments at least some of the electrical functions can be tied together remotely whereby the transmitting means of the electrical signals is not one or more cables 82 but rather radio waves. Techniques are well known and obvious to those skilled in the electrical, electronic and electromagnetic arts for practicing lateral direction control means for continually commanding rudder control unit 76 to maintain lateral deviation angles $b_p$ and $b_s$ approaching zero degrees.

In one example boom 36 weighs about 2,000 lbs., is 120 feet long, having 3-ft. side triangular cross-section and made of tubular steel construction. Float 42 is a 25 ft.×5 ft. modified displacement hull. Tow wire 44 is a 75 ft. length of 0.5 in. diameter steel cable. Depressor 50 is a 500 lb. Kite-Otter of approximate dimensions 65 in. length×63 in. width×9 in. depth. Sweepwires 52 and 58 are each 200 ft. long, 0.28 in. diameter steel cable. Diverters 64 and 66 are paravanes in accordance with Pickett et al. at U.S. Pat. No. 4,463,701, having approximate dimensions 36 in. length×34 in. width×20 in. depth. Five Mark 17 cutters 68 and five Mark 17 cutters 70 are appropriately spaced about port sweepwire 52 and starboard sweepwire 58. These sizes, dimensions and components are appropriate for protecting destroyer, frigate and cruiser-type vessels on the order of 400 ft. in length×25 ft. in beam width; they are merely illustrative of one of the many embodiments of the present invention which can be used for many applications thereof. The self-contained minesweeping system of the present invention is deployable for any type of large vessel.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. A self-contained minesweeping system for protecting a surface vessel from deleterious contact with explosive mines in water, said vessel moving through said water in a path generally forward of the bow of said vessel, each said mine having mooring means attached to said mine, comprising:

a mount located at said bow of said vessel;

a boom having a fore end and an aft end, said aft end pivotably attached to said vessel at said mount and said fore end projecting from said vessel in a generally forward and downwardly oblique direction;

a float, buoyant in said water, attached to said boom at said fore end of said boom;

lateral deviation control means for maintaining said projecting of said fore end of said boom in said generally forward direction, whereby the line defined by the length of said boom lies in a vertical plane which is maintained at an angle approaching zero degrees with respect to the line defined by the length of said vessel;

a tow wire having an upper end and a lower end, said upper end attached to said boom at a location adjacent said fore end of said boom;

a port sweepwire having an inward end and an outward end, said inward end of said port sweepwire attached to said tow wire at a location adjacent said lower end of said tow wire, said outward end of said port sweepwire projecting in a generally horizontal and backwardly oblique portwise direction, whereby said port sweepwire deflects toward said outward end of said port sweepwire each said mine having a mooring means which contacts said port sweepwire;

a starboard sweepwire having an inward end and an outward end, said inward end of said starboard sweepwire attached to said tow wire at a location adjacent said lower end of said tow wire, said outward end of said starboard sweepwire projecting in a generally horizontal and backwardly oblique starboardwise direction, whereby said starboard sweepwire deflects toward said outward end of said starboard sweepwire each said mine having a mooring means which contacts said starboard sweepwire;

port diverting means attached to said port sweepwire at said outward end of said port sweepwire, said port diverting means hydrodynamically maintaining said projecting of said outward end of said port sweepwire in said generally horizontal and backwardly oblique portwise direction;

starboard diverting means attached to said starboard sweepwire at said outward end of said starboard sweepwire, said starboard diverting means hydrodynamically maintaining said projecting of said outward end of said starboard sweepwire in said generally horizontal and backwardly oblique starboardwise direction;

port cutting means attached to said port sweepwire at a location adjacent said outward end of said port sweepwire, whereby said mooring means attached to each said mine which is deflected toward said outward end of said port sweepwire is severed by said port cutting means and said mine rises to the surface of said water outside said path of said vessel;

starboard cutting means attached to said starboard sweepwire at a location adjacent said outward end of said starboard sweepwire, whereby said mooring means attached to each said mine which is deflected toward said outward end of said starboard sweepwire is severed by said starboard cutting means and said mine rises to the surface of said water outside said path of said vessel; and depressing means, submerged in said water, attached to said tow wire at said lower end of said tow wire, said depressing means maintaining submergence in said water of said lower end of said tow wire, said inward end of said port sweepwire, and said inward end of said starboard sweepwire.

2. A self-contained minesweeping system as in claim 1, wherein said lateral deviation control means includes sensing means contained in said mount, rudder control means contained in said float, and transmitting means for sending electrical signals from said sensing means to said rudder control means, whereby said transmitting means continuously sends said electrical signals to said rudder control means from said sensing means and said rudder control means continuously steers said float in accordance with said signals so as to maintain said angle approaching zero degrees.

3. A self-contained minesweeping system as in claim 2, wherein said transmitting means includes electrical wiring.

4. A self-contained minesweeping system as in claim 2, wherein said lateral deviation control means is remote control and said transmitting means is radio.

5. A self-contained minesweeping system as in claim 2, wherein said lateral deviation control means includes manual overriding means for ceasing operation of said sensing means and whereby said transmitting means sends said electrical signals to said rudder control means from said manual overriding means instead of from said sensing means.

6. A self-contained minesweeping system as in claim 5, wherein said lateral deviation control means includes monitoring means for checking said operation of said sensing means.

* * * * *